US009463899B2

(12) United States Patent
Strominger

(10) Patent No.: US 9,463,899 B2
(45) Date of Patent: Oct. 11, 2016

(54) SNACK STORAGE CONTAINER FOR USE IN CONNECTION WITH A BEVERAGE CONTAINER

(71) Applicant: Bonnie Sussman Strominger, New York, NY (US)

(72) Inventor: Bonnie Sussman Strominger, New York, NY (US)

(73) Assignee: Crazy Minds LLC, New York, NY (US)

( * ) Notice: Subject to any disclaimer, the term of this patent is extended or adjusted under 35 U.S.C. 154(b) by 0 days.

(21) Appl. No.: 14/295,754

(22) Filed: Jun. 4, 2014

(65) Prior Publication Data

US 2014/0346169 A1 Nov. 27, 2014

Related U.S. Application Data

(63) Continuation-in-part of application No. 13/911,777, filed on Jun. 6, 2013.

(60) Provisional application No. 61/657,235, filed on Jun. 8, 2012.

(51) Int. Cl.

| | |
|---|---|
| ***A47G 19/00*** | (2006.01) |
| ***B65D 21/02*** | (2006.01) |
| ***B65D 1/26*** | (2006.01) |
| ***B65D 81/32*** | (2006.01) |

(52) U.S. Cl.

CPC ..... *B65D 21/0209* (2013.01); *B65D 1/265* (2013.01); *B65D 81/3205* (2013.01); *B65D 2231/022* (2013.01)

(58) Field of Classification Search

CPC ..... B65D 2543/00092; B65D 81/3205; B65D 51/28; B65D 2543/00046; B65D 2543/00296; B65D 2231/022; B65D 1/04; A47G 19/2222; A47G 19/2272; A47G 2019/122

USPC ..... 220/23.86, 521; 222/129

See application file for complete search history.

(56) References Cited

U.S. PATENT DOCUMENTS

| | | | | |
|---|---|---|---|---|
| 4,770,318 | A | 9/1988 | Earl | |
| 4,955,503 | A | 9/1990 | Propes | |
| 5,137,210 | A | 8/1992 | Hibbs | |
| 5,180,079 | A * | 1/1993 | Jeng | A47G 19/065 206/217 |
| D467,499 | S | 12/2002 | Garza et al. | |
| D480,968 | S | 10/2003 | Atkins et al. | |
| 7,111,748 | B2 | 9/2006 | Cha | |
| 7,676,909 | B2 | 3/2010 | MacKenzie et al. | |
| 7,882,991 | B2 | 2/2011 | Schechter | |
| 8,631,957 | B2 | 1/2014 | Dart et al. | |
| 2008/0073415 | A1 | 3/2008 | Kuighadush | |
| 2008/0099494 | A1* | 5/2008 | Boukais | B65D 77/283 220/709 |
| 2011/0210126 | A1 | 9/2011 | Vovan | |
| 2012/0168329 | A1* | 7/2012 | Berggren | A24F 23/04 206/256 |
| 2012/0168440 | A1 | 7/2012 | Nerswick et al. | |
| 2012/0273500 | A1 | 11/2012 | Yao | |
| 2013/0001233 | A1* | 1/2013 | Hylton | A47G 19/2272 220/592.2 |
| 2013/0056463 | A1 | 3/2013 | Buck | |
| 2013/0228486 | A1 | 9/2013 | Buck | |

* cited by examiner

*Primary Examiner* — Shawn M Braden

(74) *Attorney, Agent, or Firm* — Baker & Hostetler LLP

(57) ABSTRACT

The present disclosure discloses a snack container adapted for use with a beverage container comprising a lid, a beverage container engaging portion shaped to engage a rim portion of a beverage container, at least one sidewall, and a floor, wherein the lid is adapted to open and close for a user thereof.

4 Claims, 20 Drawing Sheets

SNACK STORAGE CONTAINER FOR USE IN CONNECTION WITH A BEVERAGE CONTAINER

CROSS-REFERENCE TO RELATED APPLICATIONS

This application is a continuation-in-part of Ser. No. 13/911,777, entitled Snack storage container for use in connection with a beverage container, filed on Jun. 6, 2013, which claims priority from provisional application U.S. Application Ser. No. 61/657,235, filed on Jun. 8, 2012, entitled Beverage Cup with Snack Storage, the entire contents of which are expressly incorporated herein in their entirety by reference.

TECHNICAL FIELD

The present disclosure is in the technical field of snack storage technology. More particularly, the present disclosure is in the technical field of snack storage technology, wherein a snack storage container is useable in connection with a beverage container such that the combinations of the two, as a unit, are capable of holding beverages and foods separately and simultaneously in one combination snack and beverage unit. Other aspects of the present disclosure include a snack storage container that is resealable, detachable, and may include a covering or lid that never needs to be removed. In addition, some embodiments allow a user to store multiple snacks without intermixing therebetween. Some or all of the features disclosed herein may contribute to the disclosed product making it user friendly, versatile, sanitary, and reusable.

BACKGROUND

In the past, there have been patents related to apparatuses capable of holding a beverage and food or two beverages simultaneously in the same unit. The previously disclosed technologies include, but are not limited to: a beverage cup with an attached side pouch for food (Hibbs, U.S. Pat. No. 5,137,210); partitioned cups for two beverages or a beverage and a food (Propes, U.S. Pat. No. 4,955,503; Cha, U.S. Pat. No. 7,111,748; Jeng, U.S. Pat. No. 5,180,079); et al.

SUMMARY

The present disclosure relates to a snack container that may be incorporated into a unit that allows the snack container to be incorporated with a beverage container in a single unit. The present disclosure allows a consumer to hold both a beverage and food in one hand thus enabling free usage of the opposite hand. The present disclosure puts a new twist on an age old pastime of snacking, drinking and entertainment. The multiple designs provided by this disclosure help to alleviate issues that can occur in virtually any arena, i.e. walking, talking on cell, sporting events, amusement parks, theatres, and individuality to allow an individual to create their own combination of snacks and beverages by filling the unit with the components desired by the individual, i.e. various empty designs being sold to mass retailers for the home as well.

Various novel aspects of the present disclosure may include the following. The snack container of the disclosure may universally mate with and/or clip to multiple industry-standard (and non-industry standard) beverage containers (i.e., 12 oz, 16 oz, 24 oz, 36 oz, 44 oz cups, et al.). In another novel aspect of the disclosure, the snack container may include threads on a bottom portion thereof for mating with corresponding threads on a beverage container. Smaller sizes of the snack container may be provided and marketed as suitable for use with "kids" products or "for kids."

Embodiments of the present disclosure are distinctive in that once the unit is initially filled with snacks and a beverage, the top lid of the unit does not need to be completely removed to access the snacks or beverage. Additionally, multiple embodiments of the present disclosure allow a user to access the snacks and beverage without having to completely remove the lid of the snack container. Different embodiments of the present disclosure may be targeted to different markets depending on their intended use, i.e. to be used with certain types of food/snacks and beverages or in certain environments.

In one embodiment, the present disclosure is comprised of a unit comprising a top portion to hold the snack(s). In this embodiment, the lid for the top portion may be opened to access the snacks by a turn style. In other embodiments the snack portion of the unit may be accessed by a flip top hinged lid.

The above disclosed embodiments can utilize any of the following mechanisms to access the beverage in the beverage portion of the cup. In some embodiments a straw may be utilized that passes through a portal on the lid, through the snack portion of the cup, through the barrier separating the food and beverage portions, and ultimately down into the beverage for sipping. Depending on the embodiment, the straw can pierce through the middle of the cup downwards, the end of the top lid, or pierce through the side of the upper portion of the beverage. The straw may be extra-long in length and bendable, created by multiple compositions of engineering. In alternative embodiments that do not utilize a straw, a sip spout feature that opens and closes is used to access the beverage portion of the cup.

As previously mentioned, the present disclosure comprises a barrier that separates the food container and beverage container portions of the unit. The configuration of the barrier may be dependent upon which variations are used to access the food in the snack portion and beverage in the beverage portion of the unit.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

In the drawings.

DETAILED DESCRIPTION

Figure 1:
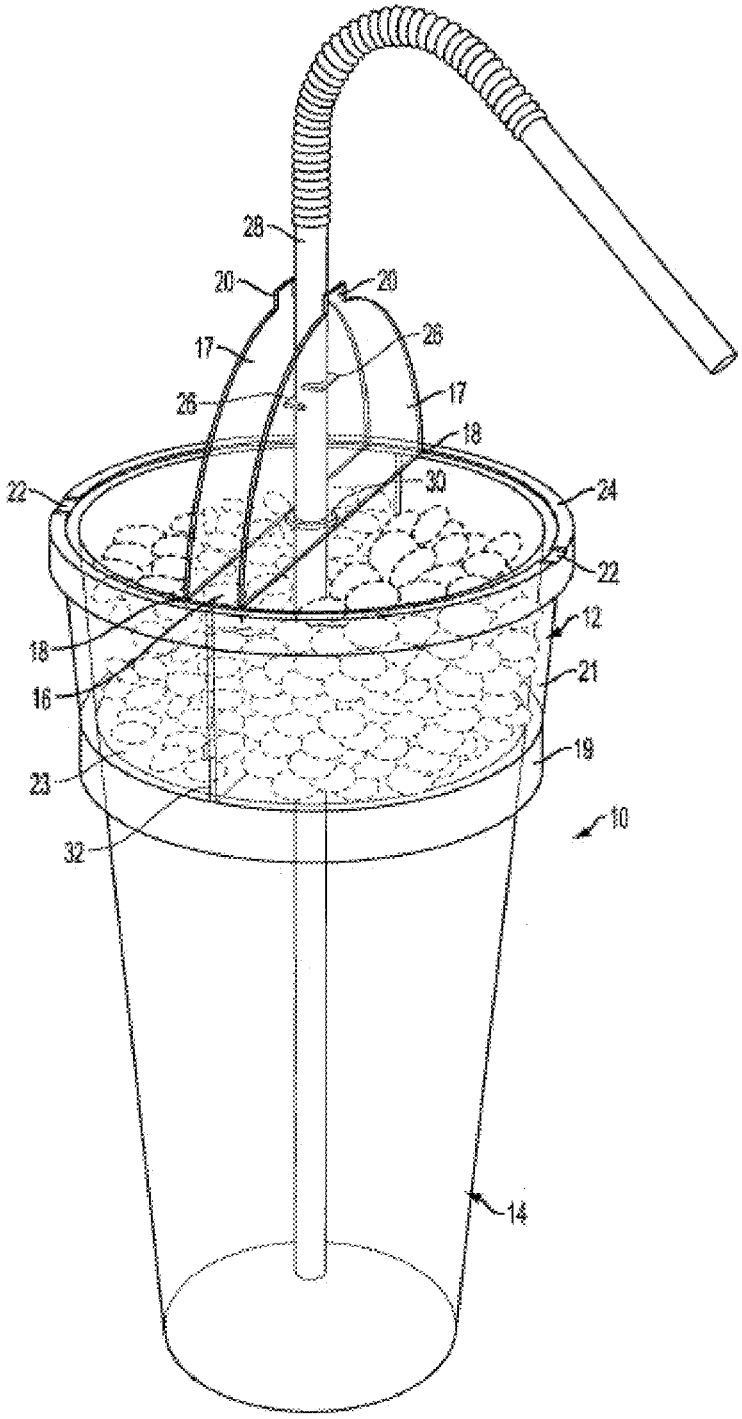
FIG. 1 is a transparent, perspective view of a combination snack container and beverage container incorporated into a single unit in accordance with aspects of the present disclosure having dual hinged lids depicted in an open position.
Figure 2:
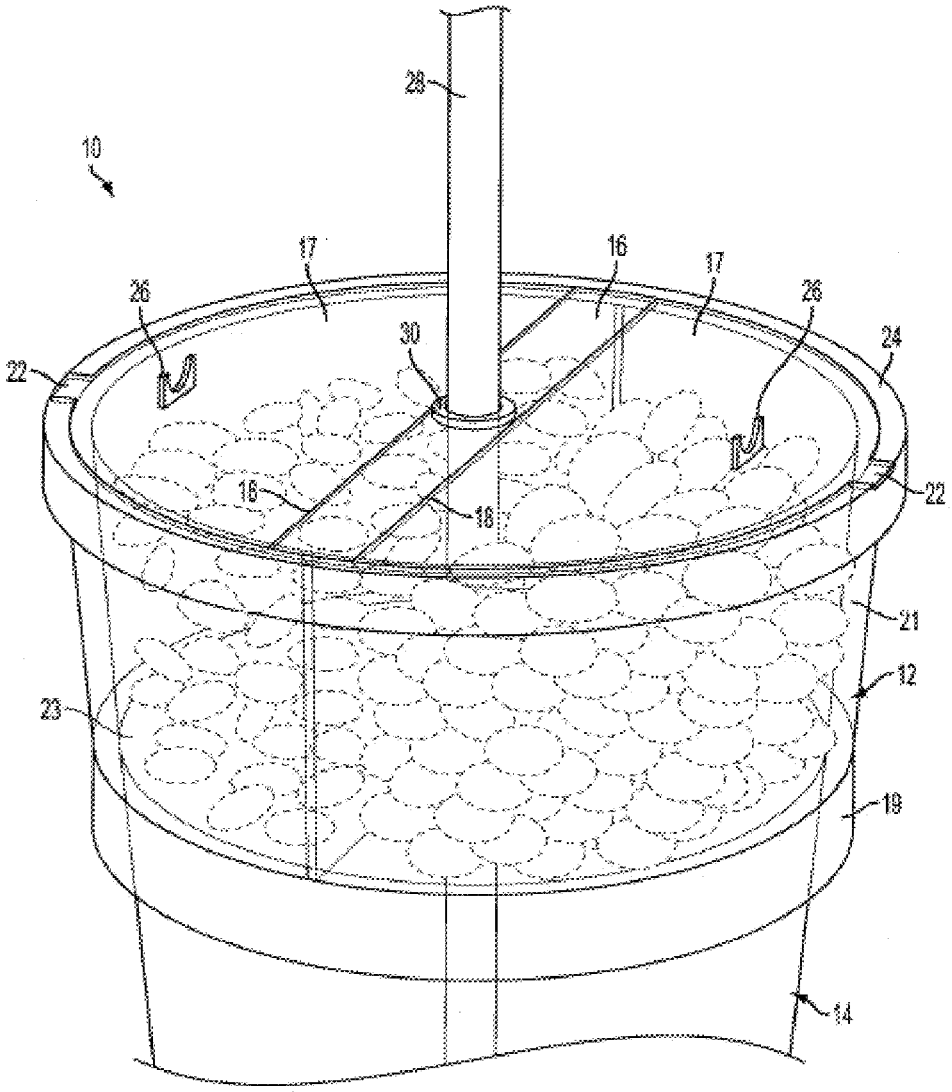
FIG. 2 is a close-up transparent, perspective view of the combination snack container and beverage container of FIG. 1 having dual hinged lids depicted in a closed position.

As shown best in FIGS. 1 and 2, the present disclosure is directed to a snack and beverage unit 10 comprised of a snack container 12 and a beverage container 14. In aspects of the disclosure, the snack container 12 may include a dual lid 16, having dual lid portions 17, a beverage container engaging portion 19 shaped to engage a rim portion of a beverage container 14, at least one sidewall 21, and a floor 23. The dual lid portions 17 may be hinged to the lid 16 by hinges 18 allowing the dual lid portions 17 to pivot between open and closed positions. The dual lid portions 17 may also include tabs 20 on an outer periphery thereof which are shaped and sized to be received in corresponding friction fit slots 22 located on a rim edge 24 of the snack container 12.

Preferably, the tabs 20 are slightly larger than the friction fit slots 22 so that they may be frictionally received therein in a snap-type fit.

In aspects of this embodiment, the dual lid portions 17 may include snap-fit clips 26 thereon that are shaped and sized to snap onto a straw 28. While such clips 26 may be of any design, preferably such clips 26 are shaped in a semi-circle configuration to provide an interference snap-type fit on straw 28. The clips 26 allow a user of the unit 10 to keep the lid portions 17 open to allow access to snacks in the snack container 12 as desired. In an embodiment, such as disclosed in FIGS. 1 and 2, wherein dual lid portions 17 are utilized, the clips 26 may be staggered on the lid portions 17 to prevent the clips 26 from interfering with each other when engaging the straw 28. The lid 16 may preferably be provided with an ingress opening 30 to provide an entry for the straw 28 through the lid, through an egress opening (not shown) and into the beverage container 14. In an embodiment of the disclosure, the snack container 12 may be provided with a partition 32 to allow a user of the snack container 12 to place two different snacks in the snack container 12 while simultaneously preventing intermixing thereof.

Figure 3:
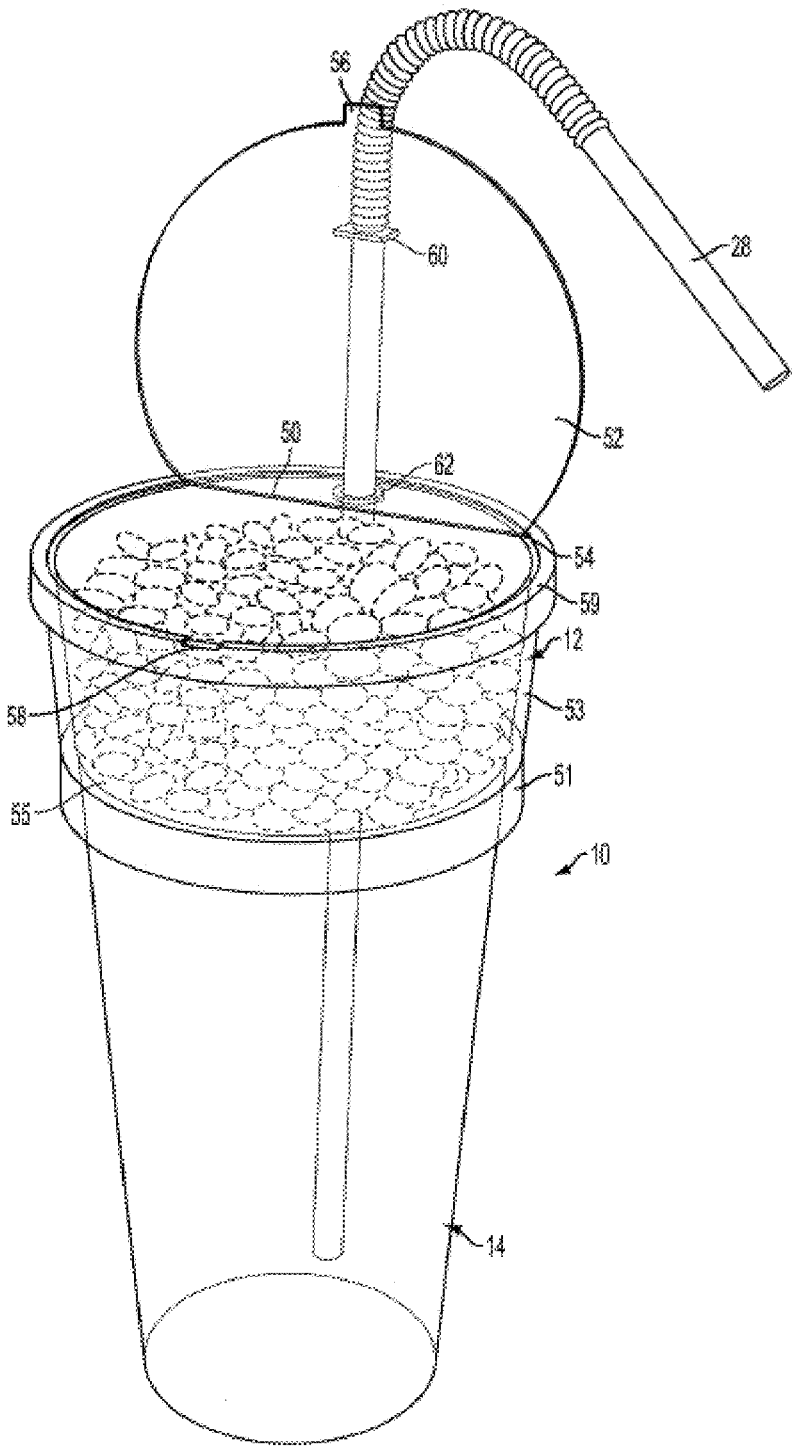
FIG. 3 is a transparent, perspective view of an alternate embodiment of a combination snack container and beverage container incorporated into a single unit in accordance with aspects of the present disclosure having a single hinged lid depicted in an open position.
Figure 4:
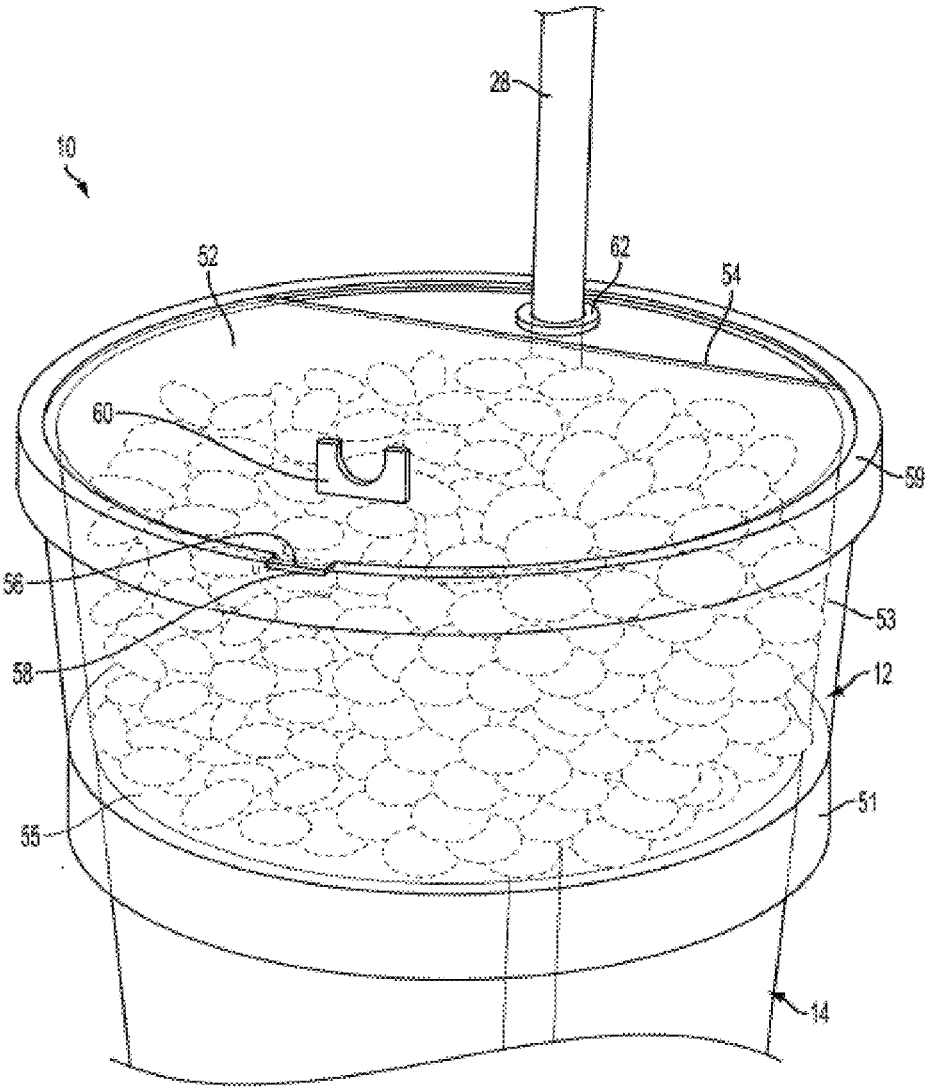
FIG. 4 is a close-up transparent, perspective view of the combination snack container and beverage container of FIG. 3 having a single hinged lid depicted in a closed position.

In aspects of the disclosure as shown best in FIGS. 3. and 4, the snack container 12 may include a single lid 50, having a single lid portion 52, a beverage container engaging portion 51 shaped to engage a rim portion of a beverage container 14, at least one sidewall 53, and a floor 55. The single lid portion 52 may be hinged to the lid 50 by hinge 54 allowing the lid portion 52 to pivot between open and closed positions. The lid portions 52 may also include tab 56 on an outer periphery thereof which is shaped and sized to be received in a corresponding friction fit slot 58 located on a rim edge 59 of the snack container 12. Preferably, the tab 56 is slightly larger than the friction fit slot 58 so that it may be frictionally received therein in a snap-type fit.

In aspects of this embodiment, the single lid portion 52 may include a snap-fit clip 60 thereon that is shaped and sized to snap onto the straw 28. While such a clip 60 may be of any design, preferably such clip 60 is shaped in a semi-circle configuration to provide an interference snap-type fit on straw 28. The clip 60 allows a user of the unit 10 to keep the lid portion 52 open to allow access to snacks in the snack container 12 as desired. The lid 50 may preferably be provided with an ingress opening 62 to provide an entry for the straw 28 through the lid 50, through an egress opening (not shown) and into the beverage container 14.

Figure 5:
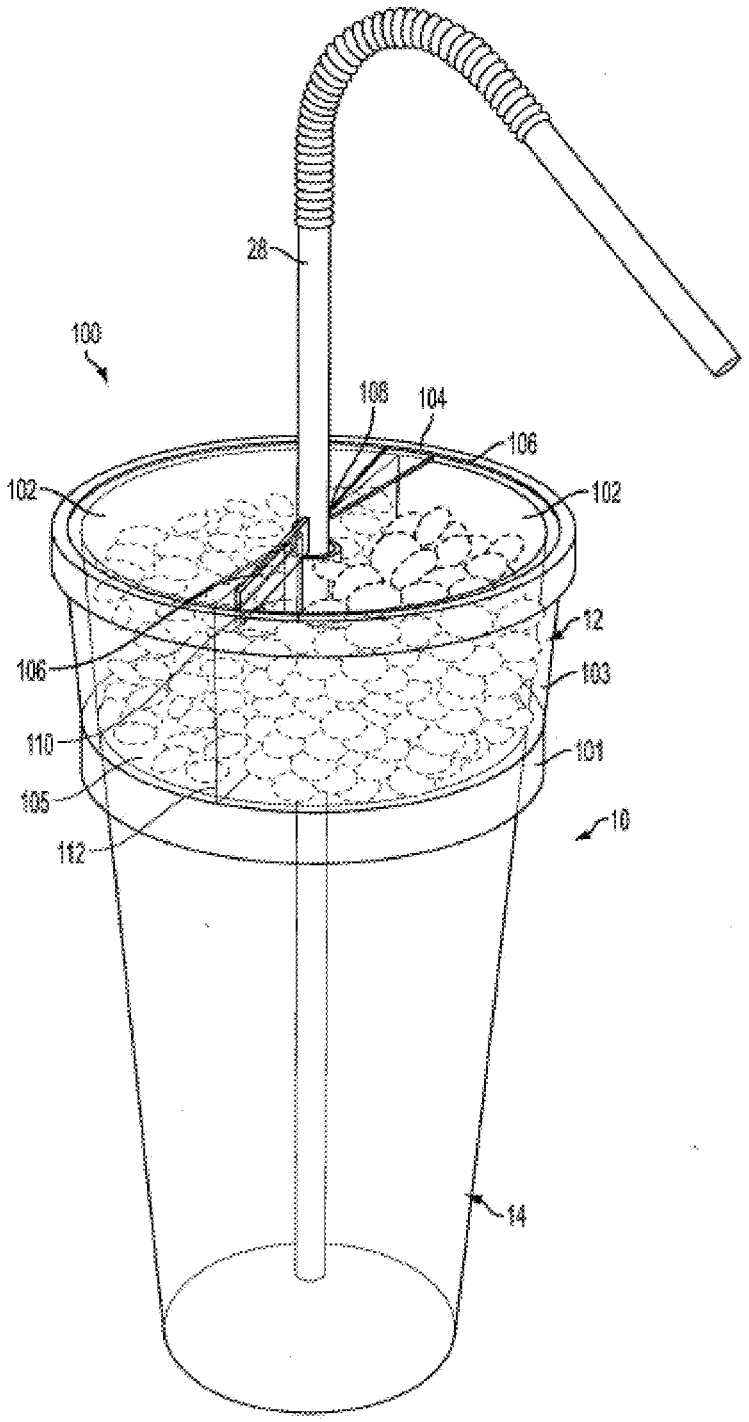
FIG. 5 is a transparent, perspective view of an alternate embodiment of a combination snack container and beverage container incorporated into a single unit in accordance with aspects of the present disclosure having a turn-style lid depicted in a partially closed position.
Figure 6:
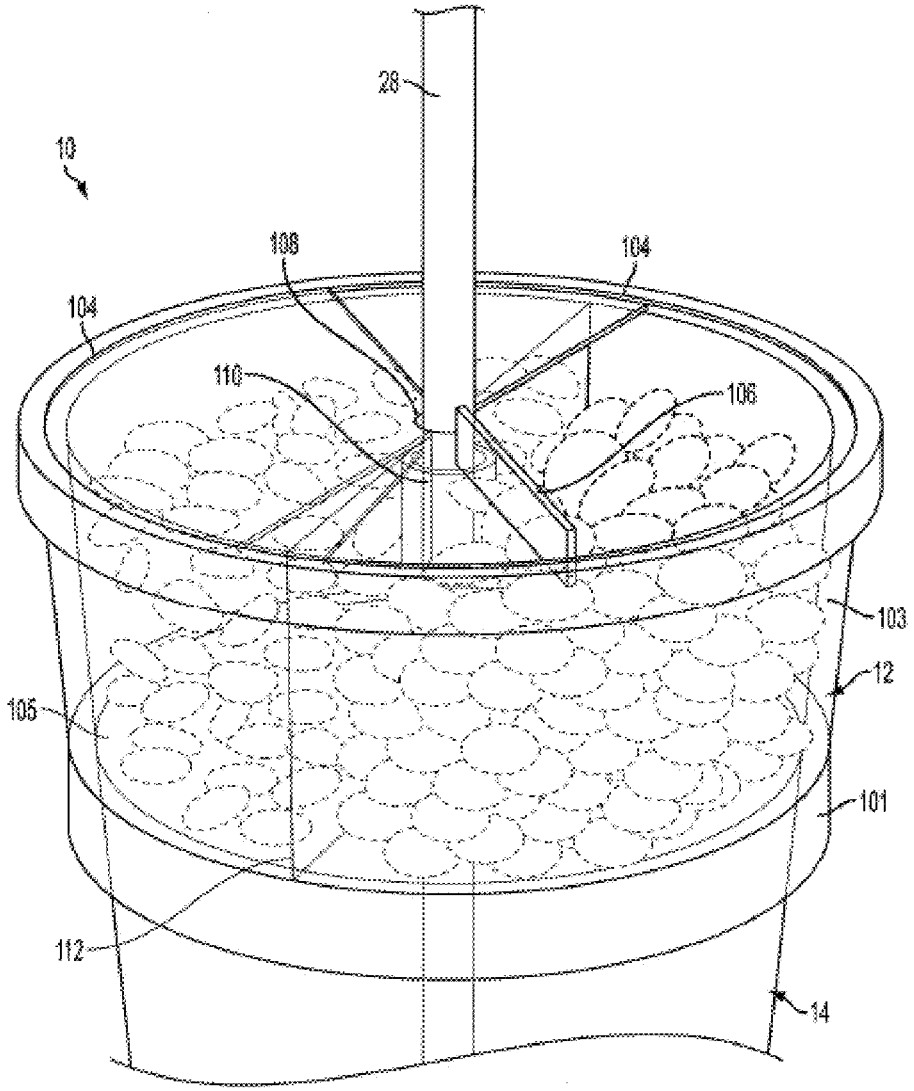
FIG. 6 is a close-up transparent, perspective view of the combination snack container and beverage container of FIG. 5 a having a turn-style lid depicted in a partially open position.

In aspects of the disclosure as shown best in FIGS. 5. and 6, the unit 10 may include a turn-style lid 100 comprised of two semi-circular lid portions 102 mounted one on top of the other for pivoting movement within corresponding slots 104 on the lid 100, a beverage container engaging portion 101 shaped to engage a rim portion of a beverage container 14, at least one sidewall 103, and a floor 105. The lid portions 102 may include a handle 106 to allow the user to more easily manipulate movement of the lid portions 102.

In aspects of this embodiment, the lid 100 may preferably be provided with an ingress opening 108 including a channel 110 through the snack container 12 to provide an entry for the straw 28, which may then proceed through an egress opening (not shown) and into the beverage container 14. In an embodiment of the disclosure, the snack container 12 may be provided with a partition 112 to allow a user of the unit 10 to place two different snacks in the snack container 12 while simultaneously preventing intermixing thereof.

Figure 7:
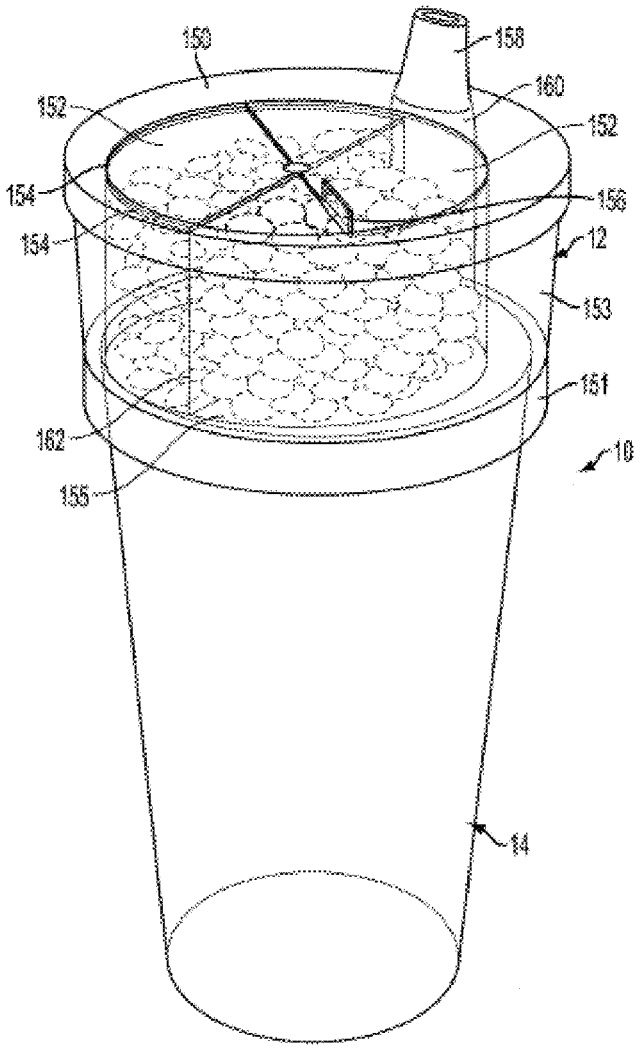
FIG. 7 is a transparent, perspective view of an alternate embodiment of a combination snack container and beverage container incorporated into a single unit in accordance with aspects of the present disclosure having a spout-style opening and a turn-style lid depicted in a closed position.
Figure 8:
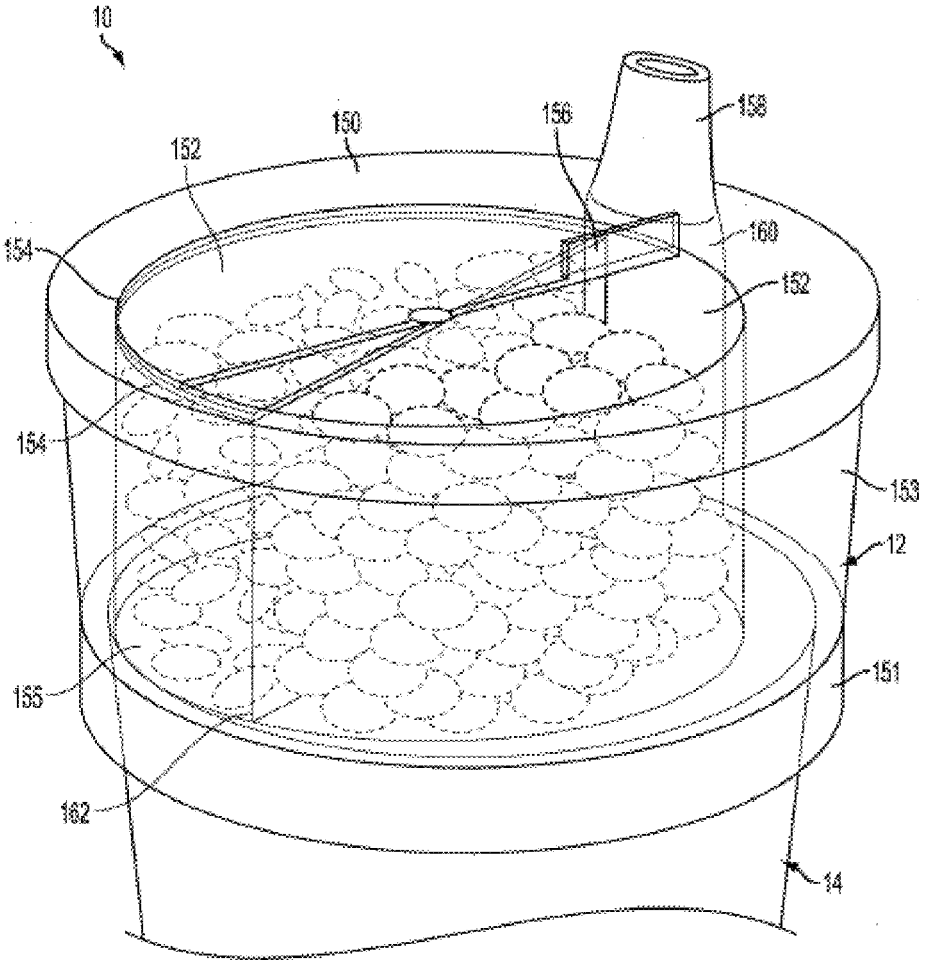
FIG. 8 is a close-up transparent, perspective view of the combination snack container and beverage container of FIG. 7 having a spout-style opening and a turn-style lid depicted in a partially closed position.

In aspects of the disclosure as shown best in FIGS. 7. and 8, the unit 10 may include a turn-style lid 150 including therein two semi-circular lid portions 152 mounted one on top of the other for pivoting movement within corresponding slots 154 on the lid 150, a beverage container engaging portion 151 shaped to engage a rim portion of a beverage container 14, at least one sidewall 153, and a floor 155. The lid portions 152 may include a handle 156 to allow the user to more easily manipulate movement of the lid portions 152.

In aspects of this embodiment, the lid 150 may preferably be provided with a spout 158 including a channel 160 through the snack container 12 to an egress opening (not shown) to provide access for a user to a beverage located in the beverage container 14. In an embodiment of the disclosure, the snack container 12 may be provided with a partition 162 to allow a user of the unit 10 to place two different snacks in the snack container 12 while simultaneously preventing intermixing thereof.

Figure 9:
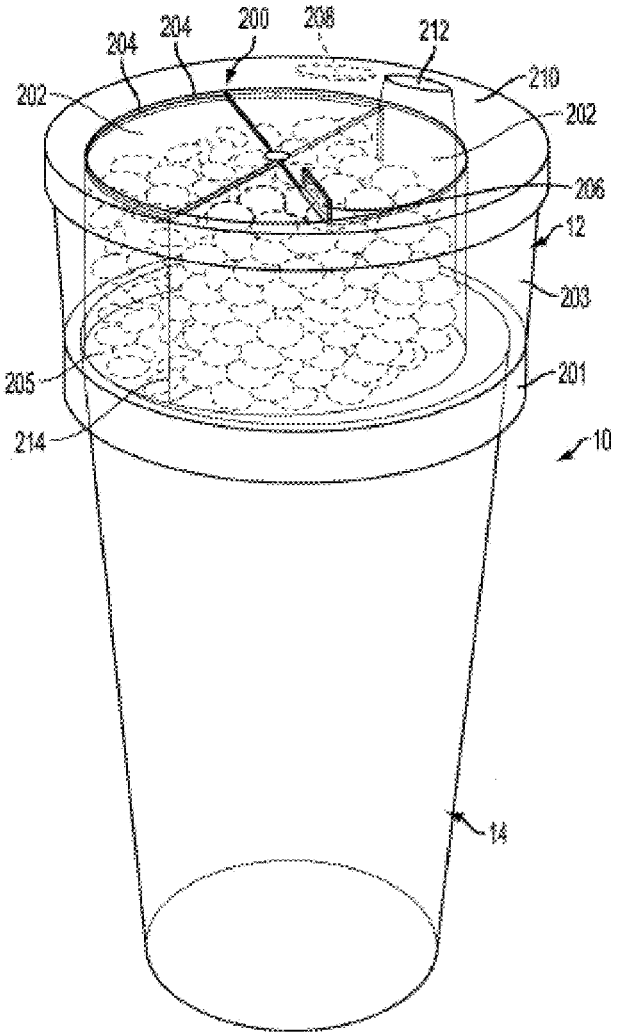
FIG. 9 is a transparent, perspective view of an alternate embodiment of a combination snack container and beverage container incorporated into a single unit in accordance with aspects of the present disclosure having a slit-style opening and a turn-style lid depicted in a closed snack and closed beverage position.

In aspects of the disclosure as shown best in FIGS. 9. and 10A and B, the unit 10 may include a turn-style lid 200 comprised of two semi-circular lid portions 202 mounted one on top of the other for pivoting movement within corresponding slots 204 on the lid 200, a beverage container engaging portion 201 shaped to engage a rim portion of a beverage container 14, at least one sidewall 203, and a floor 205. The lid portions 202 may include a handle 206 to allow the user to more easily manipulate movement of the lid portions 202.

Figure 10A:
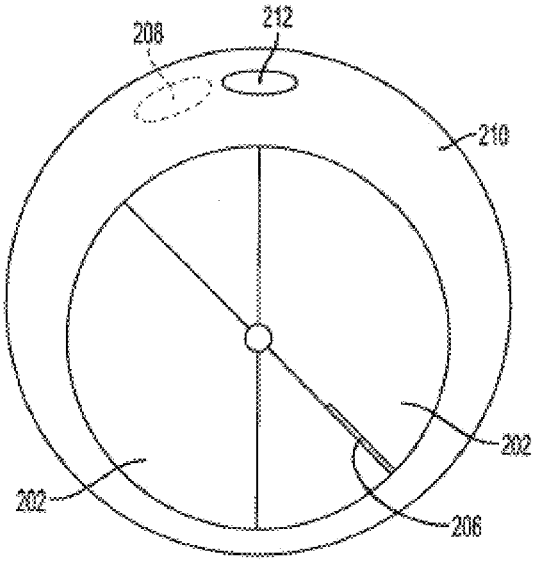
FIG. 10A is a top-plan view of the combination snack container and beverage container incorporated into a single unit of FIG. 9 depicted in an open snack and closed beverage position.
Figure 10B:
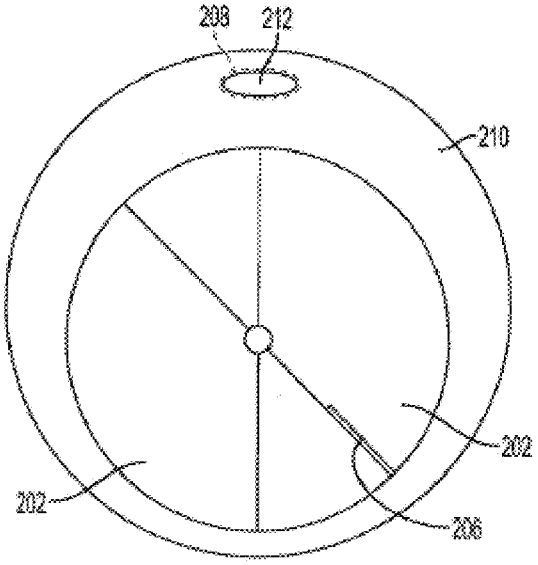
FIG. 10B is a top-plan view of the combination snack container and beverage container incorporated into a single unit of FIG. 9 depicted in an open snack and open beverage position.

In aspects of this embodiment, the lid 200 is mounted for rotational movement on the snack container 12. Accordingly, a slit 208 is preferably provided on the rim portion 210 of the lid 200 which is mounted for rotational movement on the snack container 12. A channel 212 is provided through the snack container 12 to an egress opening (not shown) to provide access for a user to a beverage located in the beverage container 14. Accordingly, as best shown in FIGS. 10A and 10B, a user can manipulate the lid 200 from a closed beverage configuration (FIG. 10A) to an open beverage configuration (FIG. 10B) by simply twisting the lid 200. In an embodiment of the disclosure, the snack container 12 may be provided with a partition 214 to allow a user of the unit 10 to place two different snacks in the snack container 12 while simultaneously preventing intermixing thereof.

Figure 11:
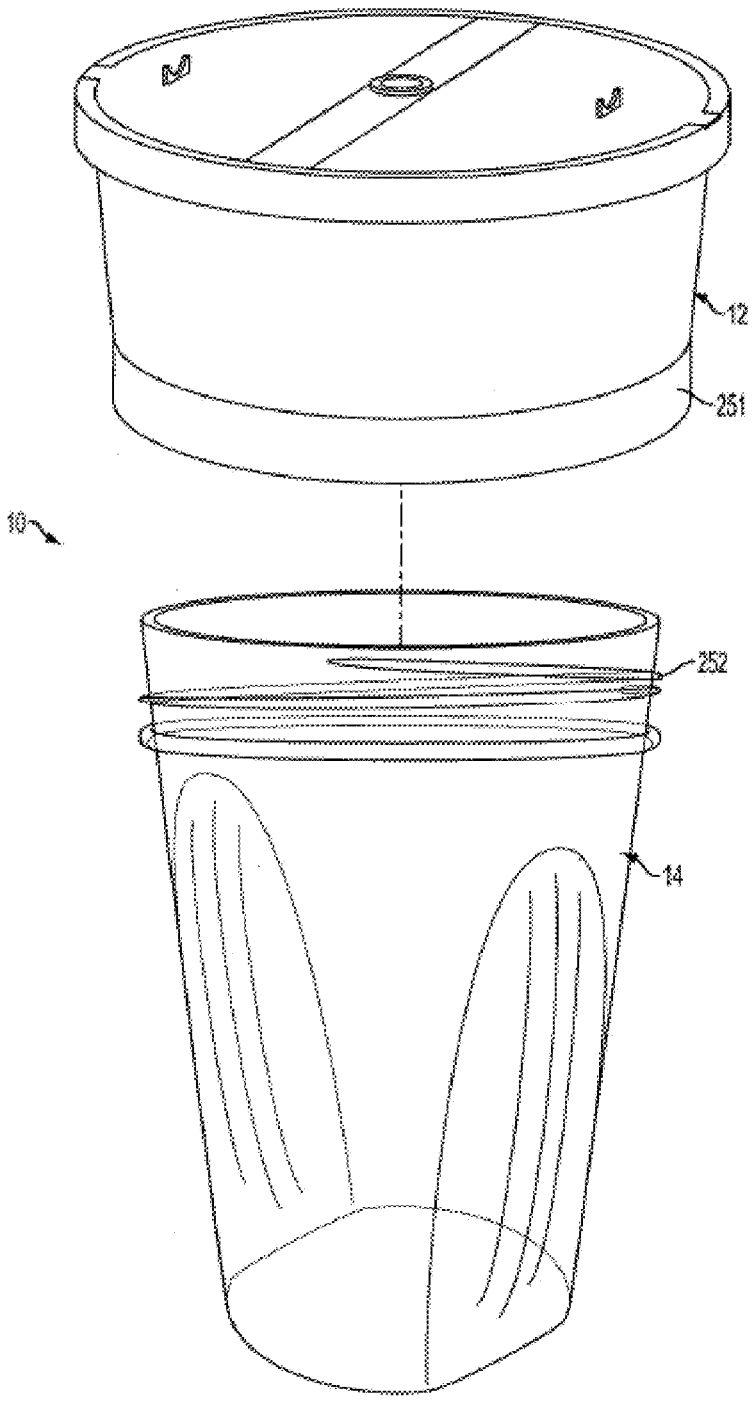
FIG. 11 is a is a transparent, perspective view of a combination snack container and beverage container incorporated into a single unit in accordance with aspects of the present disclosure showing a threaded beverage container shaped to be received by a snack container.
Figure 12:
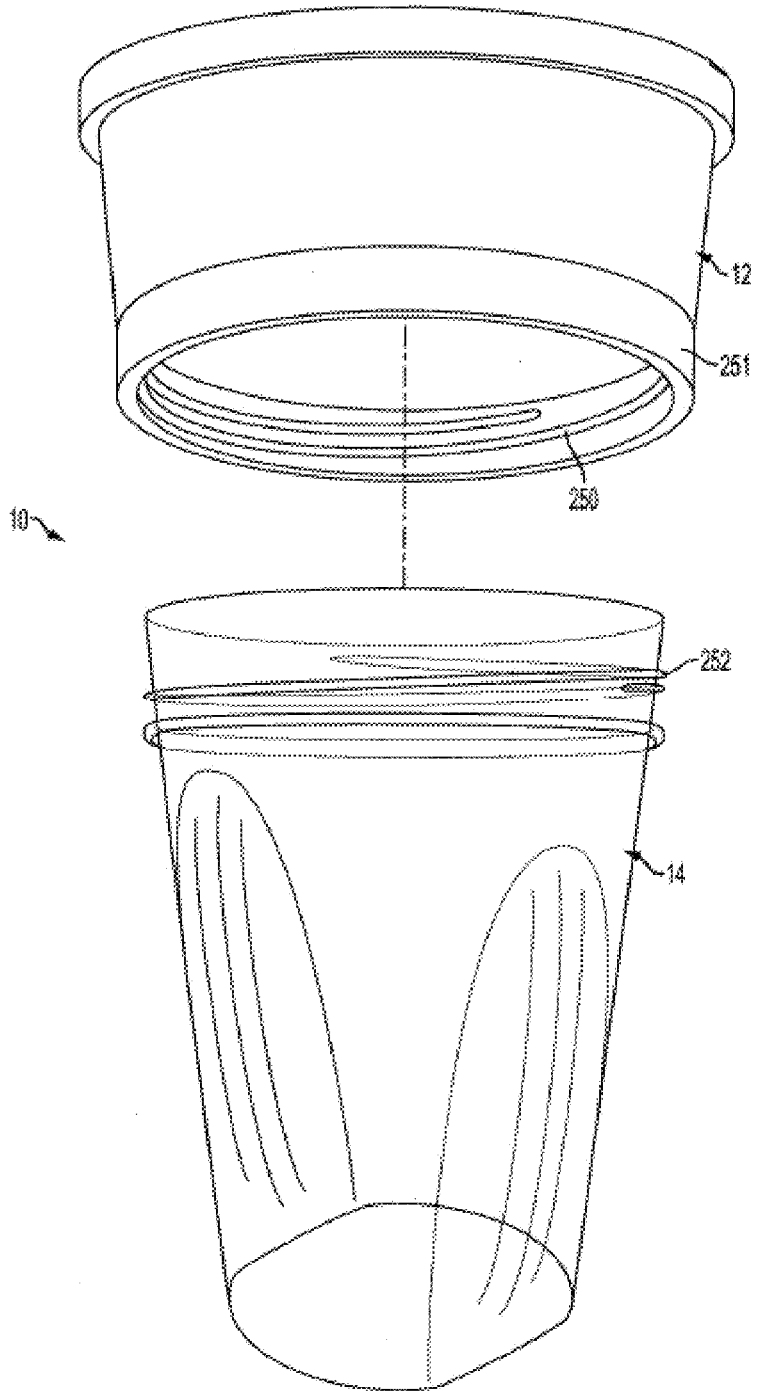
FIG. 12 is a is a transparent, perspective view of a combination snack container and beverage container incorporated into a single unit in accordance with aspects of the present disclosure showing a threaded beverage container shaped to be received by corresponding threads on a threaded snack container.

In aspects of the disclosure as shown best in FIGS. 11 and 12, the snack container 12 and beverage container 14 may be joined together by a threaded fit. Specifically, threads 250 on the beverage container engaging portion 251 of the snack container 12 may be shaped and sized to mate with corresponding threads 252 on the beverage container 14.

In aspects of the disclosure as shown above, the snack container may generally include a snack receiving portion, a lid, a beverage container engaging portion, at least one sidewall, a floor of the snack receiving portion, and a beverage egress. FIGS. 13-25 show alternate embodiments of the combined snack container and beverage container unit having aspects of the disclosure above. The features of the exemplary embodiments are described in greater detail below.

Figure 13:
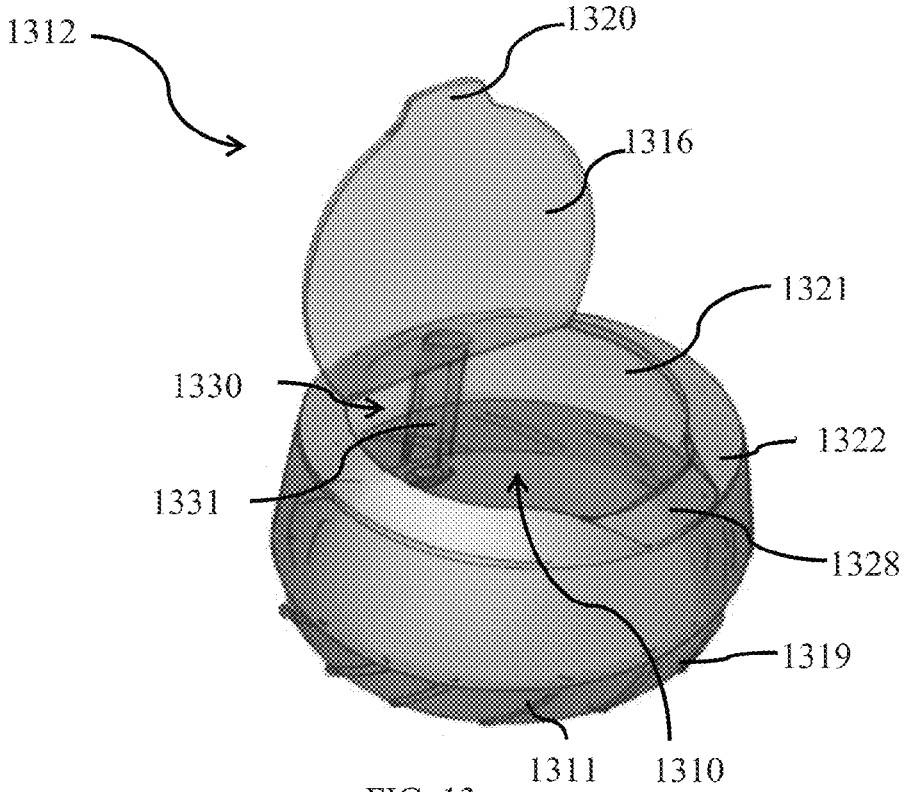
FIG. 13 is perspective view of an alternate embodiment of a combination snack container and beverage container incorporated into a single unit in accordance with aspects of the present disclosure, the embodiment having a hinged lid depicted in an open position.

In the embodiment shown in FIG. 13, the combination snack and beverage unit 1312 includes a snack compartment 1310 and a beverage egress compartment 1330 separated therefrom by sidewall 1321. Beverage egress compartment 1330 includes a channel 1331 for guiding the insertion of a straw, and further prevents fluid communication between the snack compartment 1310 and a beverage compartment (not illustrated), minimizing any potential mixing of the snack and beverage. The upper rim of snack container 1312 may taper inward to form a lipped brim 1322, allowing for a notch 1328 that tab 1320 on lid 1316 may rest within. Ridges 1311 along the outer side of the beverage container engaging portion 1319 of unit 1312 may enhance a user's grip on the snack portion for removing or connecting to the beverage portion.

Figure 14:
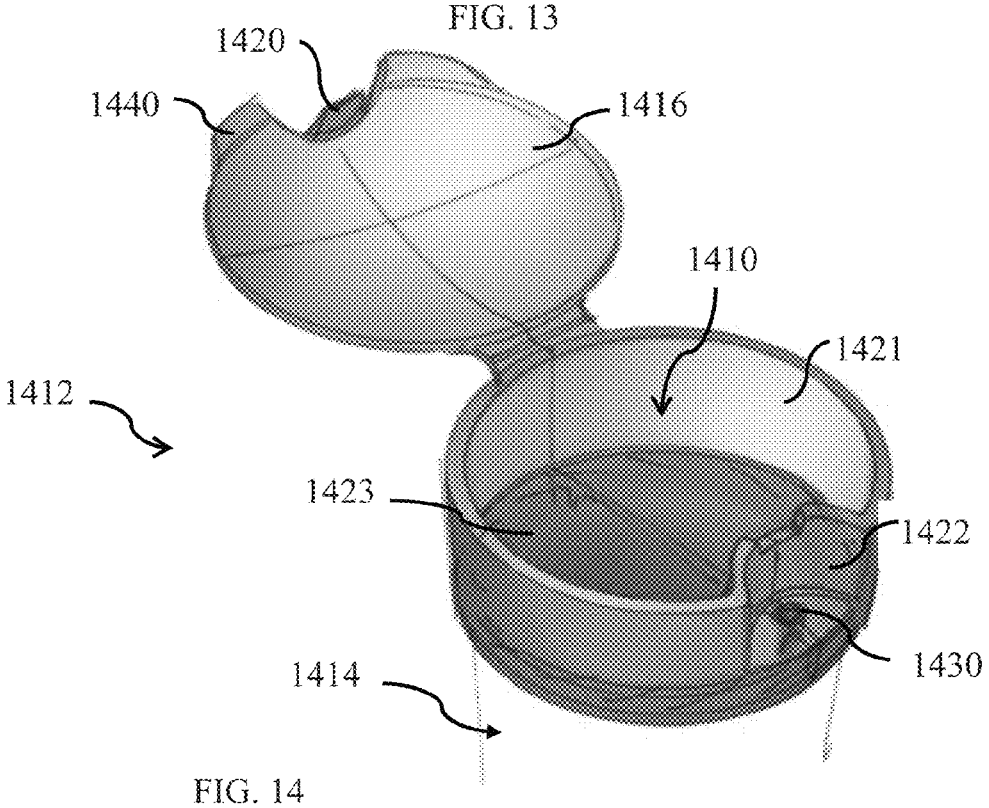
FIG. 14 is perspective view of an alternate embodiment of a combination snack container and beverage container incorporated into a single unit in accordance with aspects of the present disclosure, the embodiment having a hinged lid depicted in an open position.

In the embodiment shown in FIG. 14, the combination snack and beverage unit 1412 includes a sidewall 1421 having an inwardly curved recession 1422 to separate a snack portion 1410 from an egress 1430 to the beverage container. Egress 1430 may include a hole 1430 allowing a straw (not shown) to enter the beverage portion 1414 through floor 1423 of snack container 1412. A lid 1416 may include a biased tab 1420 to lock lid 1416 to sidewall 1421 of snack container 1410, and may further include flanges 1440 for easy manipulation. In the embodiment shown, the lid 1416 opening is located at the same side as beverage egress 1430.

Figure 15:
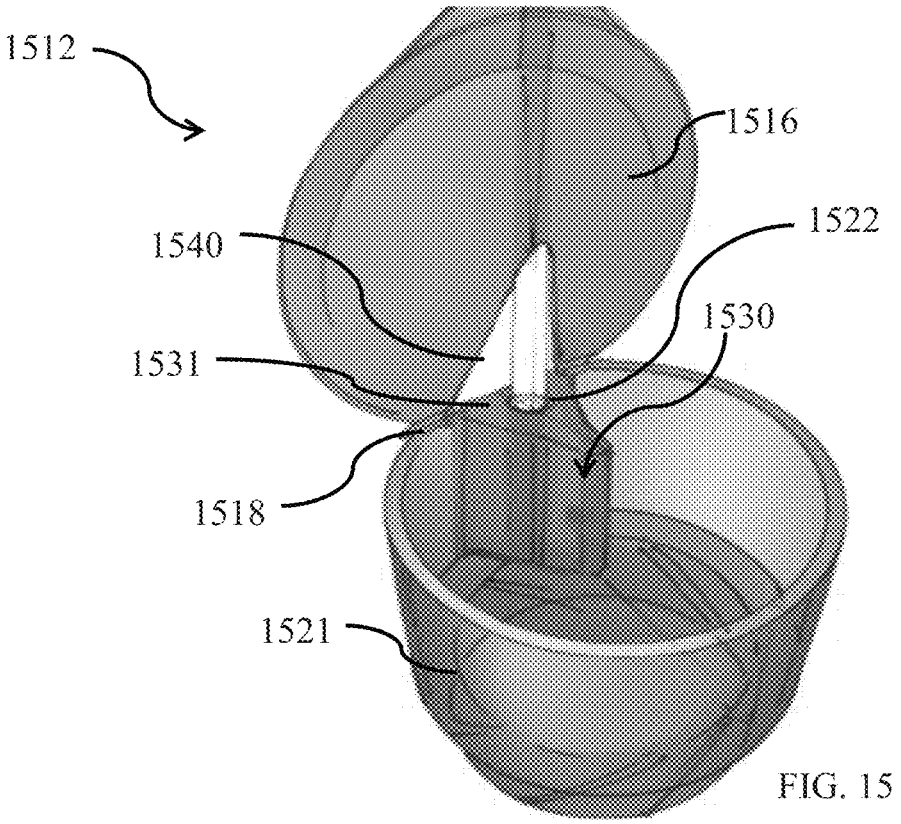
FIG. 15 is perspective view of an alternate embodiment of a combination snack container and beverage container incorporated into a single unit in accordance with aspects of the present disclosure, the embodiment having a hinged lid depicted in an open position.

As shown in the embodiment of FIG. 15, the combination snack and beverage unit 1512 may include a beverage egress compartment 1530 abutted by sidewalls 1521 to take a triangular shape. Roof 1531 of the egress compartment 1530 may be flush with the snack container lid 1516, and include a cutout 1522 for a straw to access the beverage compartment (not illustrated). Because of the placement of beverage egress compartment 1530 and hinges 1518, lid cut-out 1540 allows the lid to open unhindered by the straw.

Figure 16:
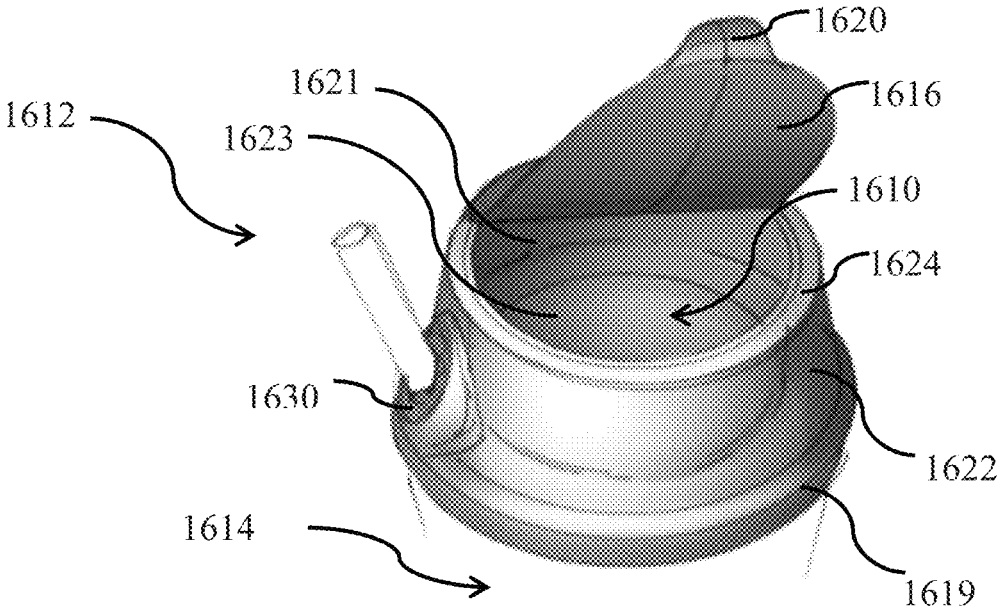
FIG. 16 is perspective view of an alternate embodiment of a combination snack container and beverage container incorporated into a single unit in accordance with aspects of the present disclosure, the embodiment having a peelable lid depicted in an open position.

The embodiment shown in FIG. 16 of the combination snack and beverage unit 1612 includes an inner sidewall 1621 suspended from the upper rim 1624 of an outer sidewall 1622, which converge to share an upper rim 1624. A snack container 1610 defined by the inner sidewall 1621 and a floor 1623 may be initially sealed by a flexible lid 1616 removably glued or otherwise adhered to rim 1624. Lid 1616 may be peeled away from rim 1624 to allow access to the interior of snack container 1610. Lid 1616 may include a tab 1620 on its periphery to facilitate the peeling of lid 1616 by a user. A beverage container engaging rim 1619 and an egress 1630 to the beverage container portion 1614 may be located at outer sidewall 1621.

Figure 17:
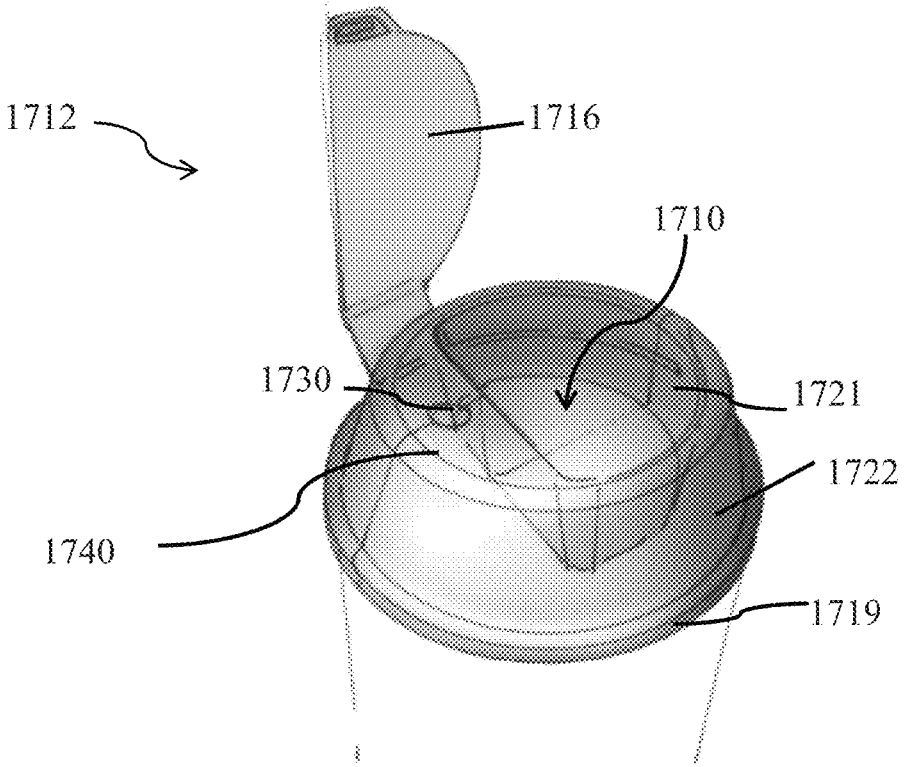
FIG. 17 is perspective view of an alternate embodiment of a combination snack container and beverage container incorporated into a single unit in accordance with aspects of the present disclosure, the embodiment having a hinged lid depicted in an open position.

The embodiment shown in FIG. 17 of the combination snack and beverage unit 1712 includes an outer sidewall 1722 having beverage container engaging rim 1719, and a roof 1740. Roof 1740 includes a beverage egress 1730, shown as an opening, for the insertion of a straw. A snack container 1710 is formed as an indention suspended from a roof 1740 defined by an inner sidewall 1721 and floor 1723. A hinged lid 1716 attached to rim 1716 removably seals snack container 1710.

Figure 18:
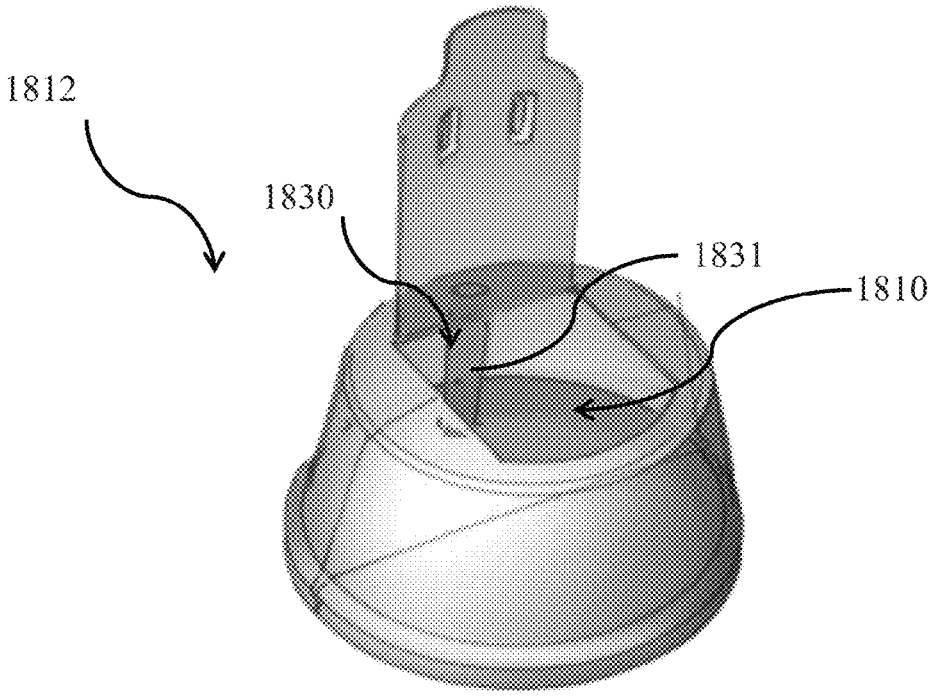
FIG. 18 is perspective view of an alternate embodiment of a combination snack container and beverage container incorporated into a single unit in accordance with aspects of the present disclosure, the embodiment having a hinged lid depicted in an open position.

The embodiment of FIG. 18 of the combination snack and beverage unit 1812 includes a beverage egress 1830 having "doughnut hole" configured channel 1831 extending through the snack container 1810, providing fluid communication between the beverage container (not shown) and the ambient air. A straw (not shown) may be inserted through channel 1831.

Figure 19:
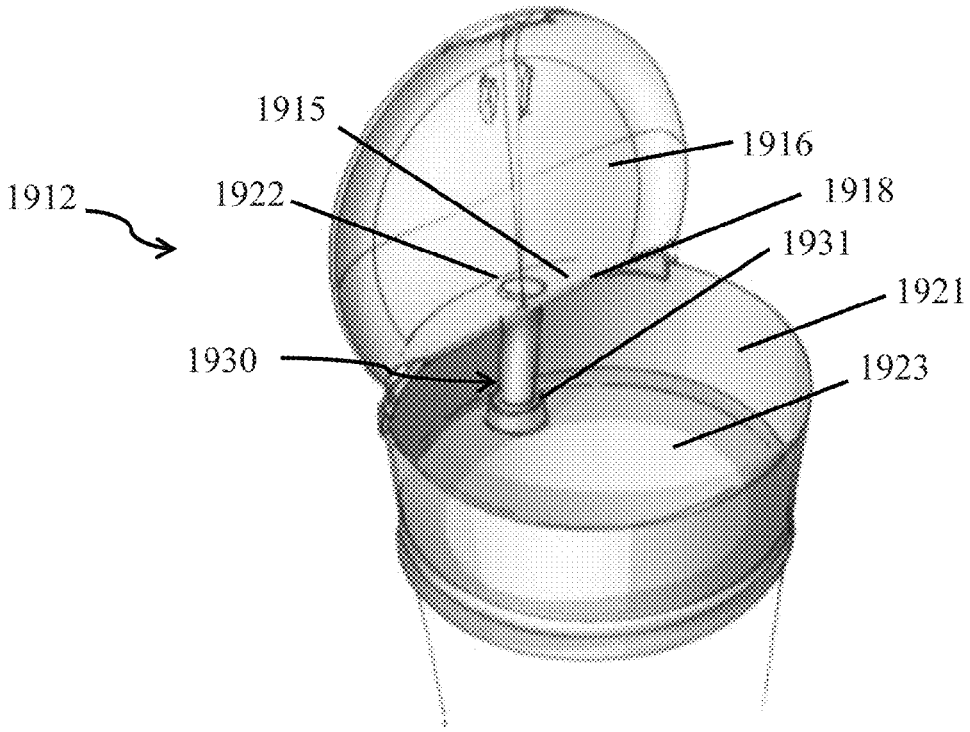
FIG. 19 is perspective view of an alternate embodiment of a combination snack container and beverage container incorporated into a single unit in accordance with aspects of the present disclosure, the embodiment having a hinged lid depicted in an open position.

The embodiment of FIG. 19 of the combination snack and beverage unit 1912 includes a hinged lid 1916, and a beverage egress 1930 adjacent to sidewall 1921. Beverage egress 1930 includes a flanged orifice 1931 on snack portion floor 1923, and corresponding upper orifice 1922 on lid 1916, both sized to receive a straw (not shown) therethrough. The upper orifice 1922 is located on a fixed portion 1915 of the lid 1916 to avoid the straw interfering with the opening of the lid 1916.

Figure 20:
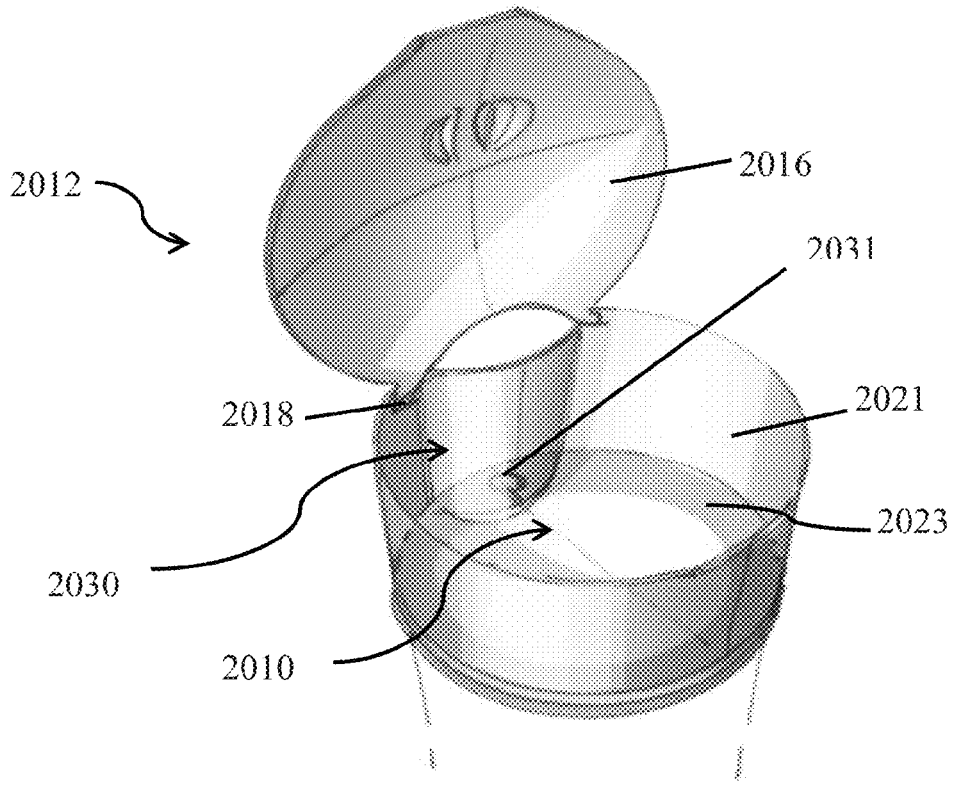
FIG. 20 is perspective view of an alternate embodiment of a combination snack container and beverage container incorporated into a single unit in accordance with aspects of the present disclosure, the embodiment having a hinged lid depicted in an open position.

The embodiment of FIG. 20 of the combination snack and beverage unit 2012 includes a snack container 2010 with sidewall 2021, where sidewall 2021 curves inward to form a recession 2022, fencing off a beverage egress 2030. Beverage egress 2030 may include an orifice 2031 at floor 2023 allowing a straw to be inserted into the beverage portion (not shown). Lid 2016 has a pair of hinges 2018 positioned at each diametric opposite of recession 2022.

Figure 21:
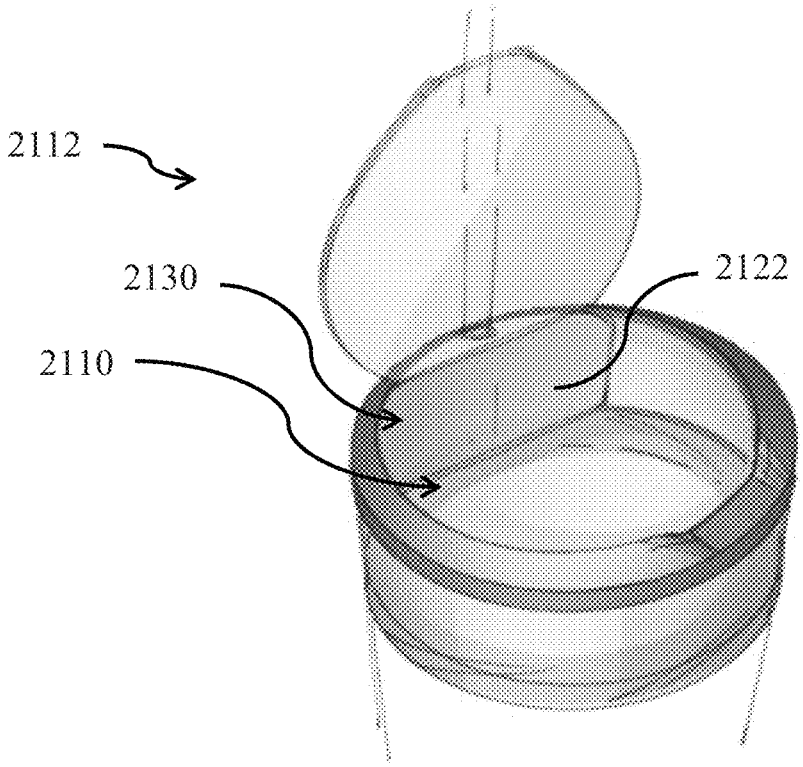
FIG. 21 is perspective view of an alternate embodiment of a combination snack container and beverage container incorporated into a single unit in accordance with aspects of the present disclosure, the embodiment having a hinged lid depicted in an open position.

In the embodiment shown in FIG. 21 of the combination snack and beverage unit 2112, a beverage egress 2130 may be separated from the snack compartment 2110 by a partition 2122 to prevent intermixing of the beverage and food.

Figure 22:
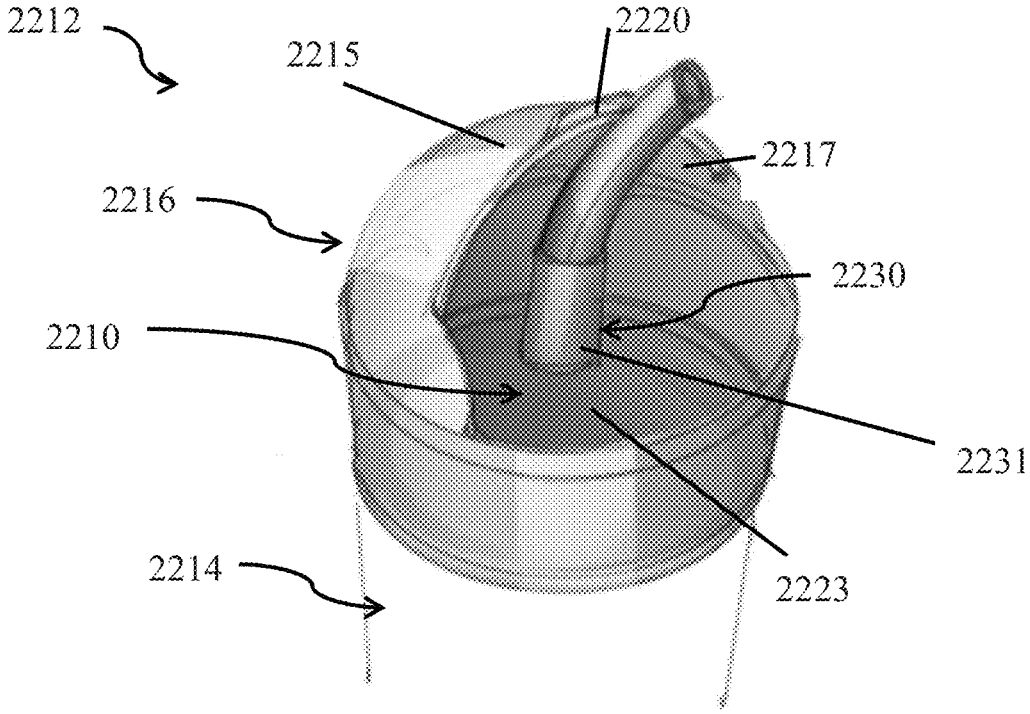
FIG. 22 is a perspective view of an alternate embodiment of a combination snack container and beverage container incorporated into a single unit in accordance with aspects of the present disclosure, having (vaulted) sliding lids depicted in an open position.

The embodiment shown in FIG. 22 of a combination snack and beverage unit 2212 includes a dome-shaped lid 2216, including a fixed first portion 2215 of the dome, and a sliding second portion 2217 of the dome, which rotationally sides to overlap the fixed portion 2215 and create an opening to the interior of snack container 2210. Second sliding portion 2217 is rotationally slidable to complete and close the domed lid 2216. Second sliding portion 2217 may include flange 2220 at a peripheral edge to allow the user to more easily manipulate movement of the second sliding portion 2217. A beverage egress 2230 includes a channel 2231 extending from the floor 2223 partway into snack container 2210, to allow for a straw insertion and fluid communication with beverage container 2214 while preventing intermixing with the snack container 2210.

Figure 23:
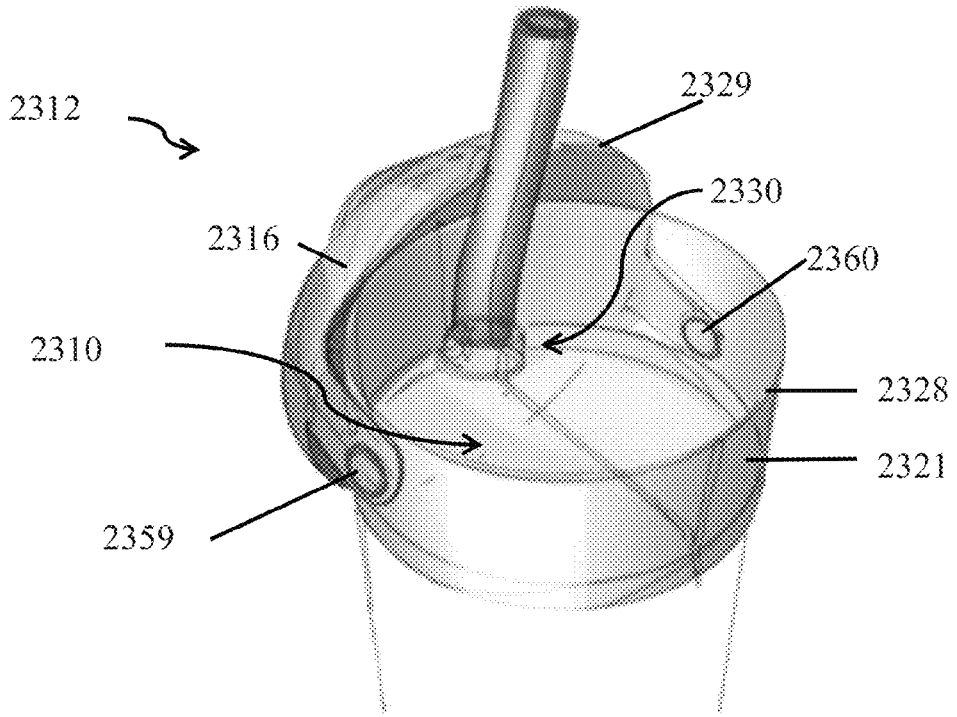
FIG. 23 is a perspective view of an alternate embodiment of a combination snack container and beverage container in accordance with aspects of the present disclosure, having a hinged lid depicted in an open position.

The embodiment shown in FIG. 23 of a combination snack and beverage unit 2312 depicts a snack container 2310 including sidewall 2321 and a domed lid 2316, where the domed lid 2316 includes a lid rim 2329 that engages with a rim 2328 of sidewall 2321. Domed lid 2316 may be flipped off entirely from snack container 2310 via one or more hinged arms 2359, rotated about a circle pivot 2360 on sidewall 2321. A beverage egress 2230 allows for fluid communication with beverage container 2214 while preventing intermixing with the snack container 2210.

Figure 24:
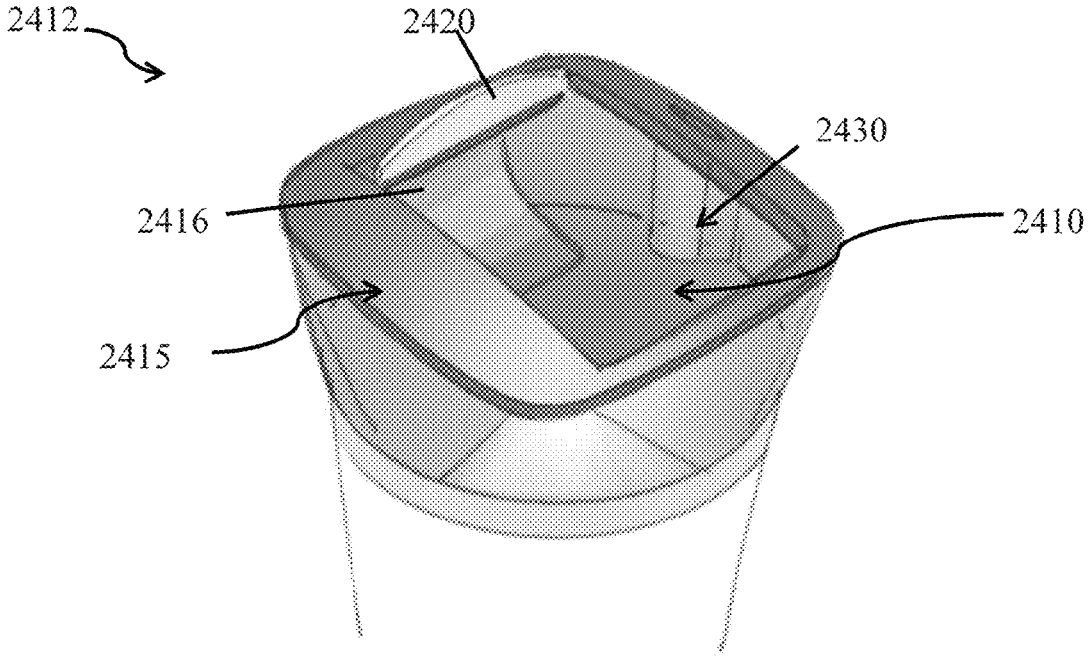
FIG. 24 is a perspective view of an alternate embodiment of a combination snack container and beverage container in accordance with aspects of the present disclosure, having a sliding lid depicted in an open position; and FIG. 25*a* and FIG. 25*b* is a perspective view of an alternate embodiment of a combination snack container, in conjunction with a beverage container of an enclosed bottle.

FIG. 24 is an embodiment of a combination snack container and beverage container 2412 having a sliding door 2416 on a portion of the lid 2415, depicted in an open position. Sliding door 2416 may be slightly curved, made of a rigid or flexible material, and slidable into snack container 2410 to create an opening in the lid 2415 for accessing snack container 2410. A tab 2420 on the periphery of door 2416 helps the user manipulate door 2416 to an open or closed position. A beverage egress 2430 allows for fluid communication with beverage container 2414 while preventing intermixing with the snack container 2410.

Any combination of the above lid styles and beverage egresses may be employed in a combination snack and beverage unit having the aspects of the disclosure.

Figure 25A:
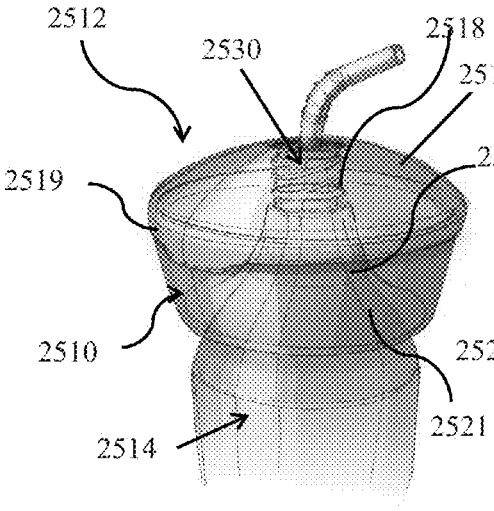
Figure 25B:
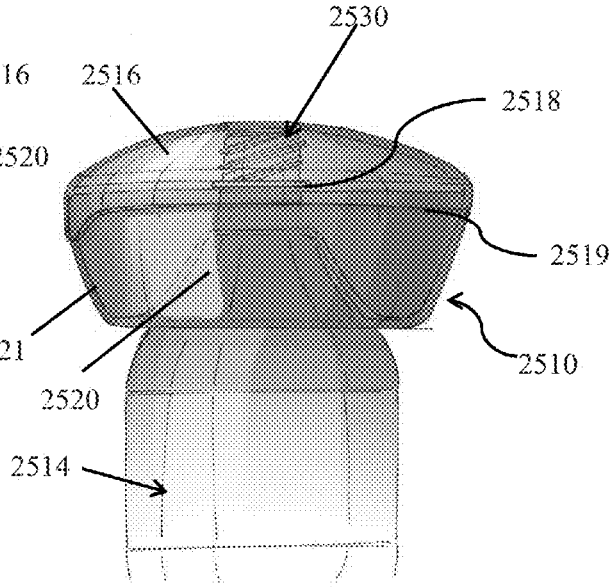

FIG. 25*a* and FIG. 25*b* are perspective views of an alternate embodiment of a combination snack and beverage unit, in use with a beverage container of an enclosed bottle. A doughnut shaped snack container 2510 includes an outer wall 2521, an inner wall 2520 shaped to fit the neck of a bottle 2514, and a removable lid 2516. Lid 2516 includes an outer rim 2519 and an inner rim 2518 shaped to engage with the outer wall 2521 and the inner wall 2520 of the snack container 2510. The outer portion of the inner wall 2520 forms a beverage egress 2530 for the bottle, sealed off from the snack container 2510.

Figure 26:
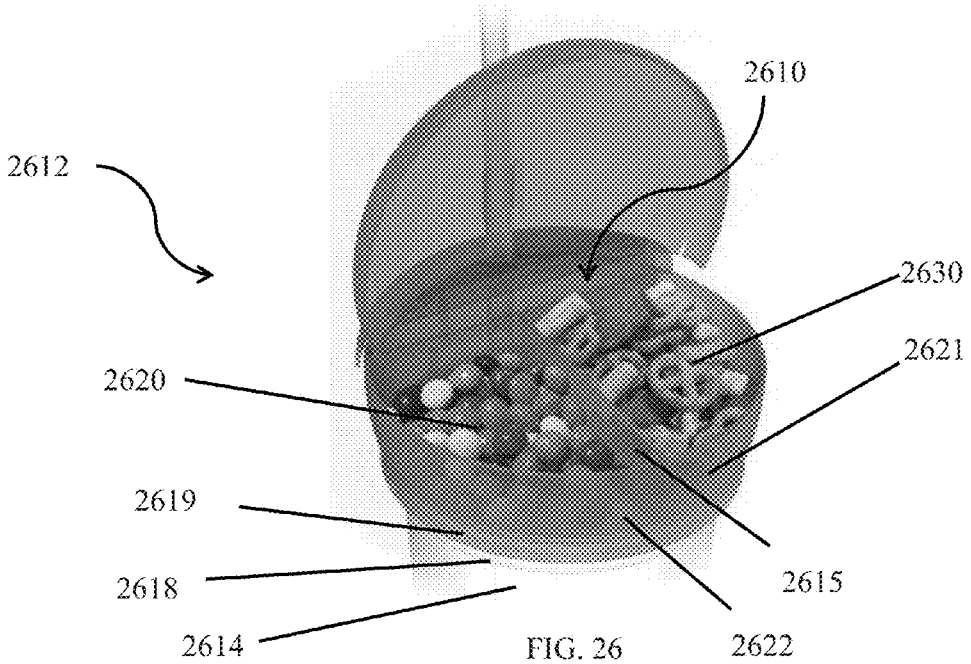
FIG. 26 is a perspective view of an alternate embodiment of a combination snack container and beverage container in accordance with aspects of the present disclosure, the embodiment having a divider in the snack container.

The embodiment shown in FIG. 26 of a combination snack and beverage unit 2612 may attach to a beverage unit 2614 by respective corresponding threaded rims 2619 and 2618. Combination unit 2621 includes a sidewall 2621 and floor 2622. Divider 2615 separates the snack portion 2610 into a first snack portion 2620 and a second snack portion 2630.

Figure 27:
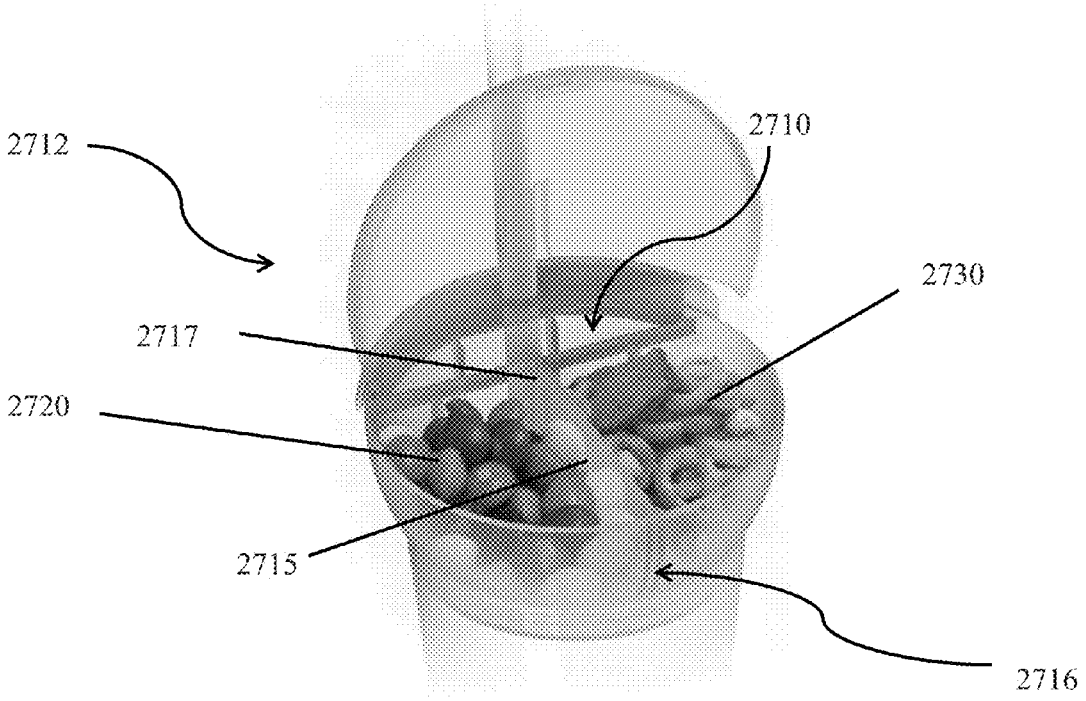
FIG. 27 is a perspective view of an alternate embodiment of a combination snack container and beverage container in accordance with aspects of the present disclosure, the embodiment having a removable divider in the snack container.

The embodiment shown in FIG. 27 of a combination snack and beverage unit 2712 includes a divider 2715 that is removable. Divider 2715 may be inserted into combination unit 2712 by sliding at least one edge into slots 2716 and 2717, to device a single snack portion 2710 into two smaller portions, a first snack portion 2720 and a second snack portion 2730.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A snack container adapted for use with a beverage container comprising:

a beverage container engaging portion shaped as a radial collar having an inner radial surface and an outer radial surface, wherein said beverage container engaging portion is configured to engage with the rim of a beverage container, an outer sidewall extending axially upward from the outer radial surface of the beverage container engaging portion and enclosing a snack container portion above the beverage container engaging portion, and including an upper rim;

a snack container portion floor extending radially inward from an upper end of the inner radial surface of the beverage container engaging portion and substantially closing the snack container portion from below the snack container portion floor, the floor including a first opening to the beverage container, wherein the first opening is located at middle of the floor;

a cylindrical channel extending axially upward from the first opening in a direction away from the beverage container and through the snack container portion, wherein the channel ends with a second opening at the end of the channel opposite to the first opening, wherein the second opening allows entry for a straw which may proceed through the channel and the first opening into the beverage container attached to the snack container;

a partition that extends outwards from opposing sides of the channel to the outer sidewall; and a dual lid that covers the snack container portion, including a lid opening aligned with the second opening of the channel, wherein the lid opening allows entry for the straw through the dual lid into the channel, wherein the dual lid further comprises:

a dual lid collar radially shaped around outer edge of the dual lid that engages the upper rim of the outer sidewall forming the snack container portion; and two dual lid portions hinged to the dual lid by hinges, wherein the hinges are located on opposing sides of the lid opening and allow the dual lid portions to pivot between an open and a closed position relative to the snack container portion to selectively provide access to the snack container portion, and further wherein the outer periphery of each dual lid portion engages the dual lid collar when in the closed position.

2. The snack container of claim 1 wherein each dual lid portion includes a snap fit clip shaped and sized to engage the straw when in the open position and wherein the snap fit clips are staggered on the dual lid portions to prevent the clips from interfering with each other when both clips are engaged with the straw.

3. The snack container of claim 1 wherein each dual lid portion includes a tab on the outer periphery thereof that are shaped and sized to be received in corresponding friction slots located on the dual lid collar.

4. The snack container of claim 3 where the tabs are slightly larger than the corresponding friction slots in order to be frictionally received in a snap-type fit.

* * * * *